US009790003B2

(12) United States Patent
Blythe

(10) Patent No.: US 9,790,003 B2
(45) **Date of Patent: *Oct. 17, 2017**

(54) VERTICAL ACTION RECLOSABLE FASTENER AND RECLOSABLE BAG HAVING SAME

(71) Applicant: Reynolds Consumer Products LLC, Lake Forest, IL (US)

(72) Inventor: James S. Blythe, Libertyville, IL (US)

(73) Assignee: REYNOLDS CONSUMER PRODUCTS LLC, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/933,437

(22) Filed: Nov. 5, 2015

(65) Prior Publication Data

US 2016/0052677 A1 Feb. 25, 2016

Related U.S. Application Data

(63) Continuation of application No. 13/841,054, filed on Mar. 15, 2013, now Pat. No. 9,187,215.

(51) Int. Cl.

| | |
|---|---|
| ***B65D 33/16*** | (2006.01) |
| ***B65D 33/25*** | (2006.01) |
| ***A44B 19/16*** | (2006.01) |

(52) U.S. Cl.

CPC ..... *B65D 33/2591* (2013.01); *A44B 19/16* (2013.01); *B65D 33/2541* (2013.01); *Y10T 24/45168* (2015.01)

(58) Field of Classification Search

CPC .. B65D 33/2591; B65D 33/2541; A44B 19/16

USPC ..... 383/63, 64; 24/399, 400, 585.12

See application file for complete search history.

(56) References Cited

U.S. PATENT DOCUMENTS

| | | | |
|---|---|---|---|
| 5,007,143 | A | 4/1991 | Herrington |
| 5,638,586 | A | 6/1997 | Malin et al. |
| 6,293,701 | B1 | 9/2001 | Tomic |
| 6,461,042 | B1 | 10/2002 | Tomic et al. |
| 6,581,249 | B1 | 6/2003 | Savicki et al. |
| 6,581,253 | B2 | 6/2003 | ErkenBrack |

(Continued)

OTHER PUBLICATIONS

U.S. Appl. No. 13/839,044, Oct. 6, 2014 Issue Fee Payment.

(Continued)

*Primary Examiner* — Jes F Pascua
(74) *Attorney, Agent, or Firm* — Baker Botts L.L.P.

(57) ABSTRACT

Reclosable fastener includes a first track including a first engagement profile having a first hook portion opening in a first direction along a reference axis substantially perpendicular to a burst direction of the fastener and a second track including a second engagement profile having a second hook portion opening in a second direction opposite the first direction along the reference axis and configured to engage the first hook portion in a closed configuration. The first and second hook portions are configured to engage each other when the first and second tracks are urged toward each other along the reference axis, and the first and second hook portions are configured to disengage each other when the first and second tracks are urged away from each other along the reference axis. A reclosable bag having a reclosable fastener and a slider for a reclosable fastener are also provided.

20 Claims, 10 Drawing Sheets

(56) References Cited

U.S. PATENT DOCUMENTS

| | | | | |
|---|---|---|---|---|
| 6,880,972 | B2 | 4/2005 | Plourde | |
| 7,162,779 | B2 | 1/2007 | Machacek | |
| 7,263,748 | B2 | 9/2007 | Blythe | |
| 7,267,856 | B2 | 9/2007 | Patel et al. | |
| 7,496,992 | B2 | 3/2009 | Ausnit | |
| 7,669,307 | B2 | 3/2010 | Patel et al. | |
| 8,087,826 | B1 | 1/2012 | Blythe et al. | |
| 8,882,349 | B2 | 11/2014 | Blythe | |
| 9,187,215 | B2 * | 11/2015 | Blythe | B65D 33/2591 |
| 9,510,651 | B2 * | 12/2016 | Blythe | A44B 19/62 |
| 2004/0037479 | A1 | 2/2004 | Bentsen | |
| 2006/0269169 | A1 | 11/2006 | Kettner et al. | |
| 2011/0317942 | A1 | 12/2011 | Blythe et al. | |
| 2014/0259571 | A1 | 9/2014 | Blythe | |

OTHER PUBLICATIONS

U.S. Appl. No. 13/839,044, Jul. 8, 2014 Notice of Allowance.
U.S. Appl. No. 13/839,496, Jan. 13, 2016 Non-Final Office Action.
U.S. Appl. No. 13/839,496, Oct. 14, 2015 Amendment and Request for Continued Examination (RCE).
U.S. Appl. No. 13/839,496, Jun. 15, 2015 Final Office Action.
U.S. Appl. No. 13/839,496, Mar. 2, 2015 Response to Non-Final Office Action.
U.S. Appl. No. 13/839,496, Nov. 28, 2014 Non-Final Office Action.
U.S. Appl. No. 13/841,054, Oct. 13, 2015 Issue Fee Payment.
U.S. Appl. No. 13/841,054, Jul. 13, 2015 Notice of Allowance.
U.S. Appl. No. 13/841,054, Jun. 29, 2015 Response after Final Office Action.
U.S. Appl. No. 13/841,054, Apr. 29, 2015 Final Office Action.
U.S. Appl. No. 13/841,054, Jan. 26, 2015 Response to Non-Final Office Action.
U.S. Appl. No. 13/841,054, Oct. 24, 2014 Non-Final Office Action.
U.S. Appl. No. 13/839,496, Oct. 28, 2016 Issue Fee Payment.
U.S. Appl. No. 13/839,496, Jul. 29, 2016 Notice of Allowance.
U.S. Appl. No. 13/839,496, Apr. 13, 2016 Response to Non-Final Office Action.

* cited by examiner

VERTICAL ACTION RECLOSABLE FASTENER AND RECLOSABLE BAG HAVING SAME

CROSS-REFERENCE TO RELATED APPLICATIONS

This application is a continuation of U.S. patent application Ser. No. 13/841,054, filed Mar. 15, 2013, which is incorporated by reference herein in its entirety

BACKGROUND OF THE INVENTION

Field of the Invention

The disclosed subject matter generally relates to reclosable fasteners with sliders particularly suited for thermoplastic bags and the like. Particularly, the disclosed subject matter relates to a track and slider configuration with increased strength and flexibility and reduced size.

Description of Related Art

Plastic bags are in widespread use in a varied and diverse number of household and commercial applications, especially in the food packaging industry. One advantage of plastic bags is their ease of opening and resealing. Some of these bags are reclosable via the use of a reclosable feature such as a reclosable fastener. In many bags, the fasteners can be opened and closed either by pressure or by the use of an auxiliary slider mechanism.

Generally, two types of such reclosable fasteners exist—(i) push to close ("PTC") and (ii) zipper. The PTC fastener requires the application of an external force to open or close the engageable tracks, whereas the zipper fastener relies upon a slider for opening or closing the rib and groove elements. As such, the profile configuration of the reclosable track of a zipper fastener often differs from that of a PTC fastener.

In the manufacture of thermoplastic film bags, a pair of male and female fastener elements or tracks extend along the mouth of the bag and these male and female elements are adapted to be secured in any suitable manner to the flexible walls of the thermoplastic film bag. These elements may be integral marginal portions of such walls or the elements may be extruded separately and thereafter attached to the walls along the mouth of the bag. U.S. Pat. Nos. 5,007,143 and 8,087,826, each of which is incorporated by reference in its entirety, describe one type of zipper profile in which the cross-sectional shape of the zipper is such that the male and female elements can be engaged or closed by pressing the bottom together first, then rolling it closed toward the top. This configuration is referred to as a "rolling action" reclosable fastener.

Furthermore, various arrangements have been utilized heretofore to maintain auxiliary slider mechanisms on fasteners. One arrangement which has been used to prevent or inhibit the slider mechanism from going past the ends of the fastener and coming off of the bag is to incorporate opposing end termination clips at the ends of the fastener. The use of end termination clips, however, increases the cost of producing the bag as it requires an additional component on the bag and an additional piece of equipment in order to place the end termination clips on the bag. In addition, the placement of end termination clips on the ends of the fastener involves an additional processing step which may not be desirable when manufacturing speeds are important.

To avoid using end termination clips to prevent or inhibit the auxiliary slider mechanism from going past ends of the fastener, an alternative arrangement has been employed which involves shaping material from the fastener into opposing end stops or end stop structures which protrude from the fastener or zipper and engage the slider mechanism to prevent or inhibit it from going past the respective ends of the fastener. U.S. Pat. Nos. 7,267,856 and 7,669,307, each of which is incorporated by reference in its entirety, describe one technique to shape end stop structures by ultrasonically smashing the opposite ends of the male and female profiles of the fastener to form the protruding end stop structures.

However, there remains an opportunity to improve the seal strength of such conventional fasteners, yet provide a fastener with increased flexibility, for example to permit the fasteners to be easily opened and closed on overstuffed bags. Additionally, there remains an opportunity to provide a fastener with reduced size that can be formed using less material than conventional fasteners.

SUMMARY OF THE INVENTION

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a reclosable fastener including a first track including a first engagement profile having a first hook portion opening in a first direction along a reference axis substantially perpendicular to a burst direction of the fastener and a second track including a second engagement profile having a second hook portion opening in a second direction opposite the first direction along the reference axis and configured to engage the first hook portion in a closed configuration. The first and second hook portions are configured to engage each other when the first and second tracks are urged toward each other along the reference axis, and the first and second hook portions are configured to disengage each other when the first and second tracks are urged away from each other along the reference axis.

The reference axis can be within 85-95 degrees of the burst direction. As embodied herein, the burst direction is defined generally by a reference line extending across a bottom of the first engagement profile and a bottom of the second engagement profile.

Further in accordance with the disclosed subject matter, at least one of the first and second engagement profiles can include a projection to inhibit disengagement of the first and second hook portions when engaged. The projection can be formed on at least one of the first hook portion and the second hook portion. In some embodiments, the projection can be formed on the first engagement profile to abut the second hook portion when the first and second tracks are urged away from each other along the reference axis. Additionally or alternatively, the first and second engagement profiles can be configured to provide a rotational spring force to inhibit disengagement of the first and second hook portions when engaged.

Furthermore, the reclosable fastener can include a slider engaging the first and second tracks. When the slider is moved from a closed position toward an open position along the first and second tracks, the slider can be configured to move the first track relative the second track in a direction along the reference axis. For example, when the slider is moved from the closed position toward the open position, the slider can be configured to move the first track in the second direction from the second track to disengage the first hook portion from the second hook portion. In some embodiments, when the slider is moved from the closed position toward the open position, the slider can be configured to move the first track along a radius greater than about one-half inch relative to the second track. As embodied herein, the fastener can have a track open force of at least 3 pounds, as determined by ASTM test method F 88/F 88M-09.

According to another aspect of the disclosed subject matter, a reclosable bag includes first and second opposing body panels fixedly connected to each other along a pair of sides and a bottom bridging the pair of sides and a reclosable fastener extending along a mouth formed opposite the bottom. The reclosable fastener includes a first track including a first engagement profile having a first hook portion opening in a first direction along a reference axis substantially perpendicular to a burst direction of the fastener, the first hook portion attached to the first body panel proximate a first area, and a second track including a second engagement profile having a second hook portion opening in a second direction opposite the first direction along the reference axis and configured to engage the first hook portion in a closed configuration, the second track portion attached to the second panel proximate a second area. The first and second hook portions are configured to engage each other when the first and second tracks are urged toward each other along the reference axis, and the first and second hook portions are configured to disengage each other when the first and second tracks are urged away from each other along the reference axis.

The reference axis can be within 85-95 degrees of the burst direction. As embodied herein, the burst direction is defined generally by a reference line extending through the first area and the second area.

Further, in accordance with the disclosed subject matter, at least one of the first and second engagement profiles can include a projection to inhibit disengagement of the first and second hook portions when engaged. The projection can be formed on at least one of the first hook portion and the second hook portion. In some embodiments, the projection can be formed on the first engagement profile to abut the second hook portion when the first and second tracks are urged away from each other along the reference axis. Additionally or alternatively, the first and second engagement profiles can be configured to provide a rotational spring force to inhibit disengagement of the first and second hook portions when engaged.

Furthermore, the reclosable fastener can include a slider engaging the first and second tracks. When the slider is moved from a closed position toward an open position along the first and second tracks, the slider can be configured to move the first track relative the second track in a direction along the reference axis. When the slider is moved from the closed position toward the open position, the slider can be configured to move the first track in the second direction from the second track to disengage the first hook portion from the second hook portion. In some embodiments, when the slider is moved from the closed position toward the open position, the slider can be configured to move the first track along a radius greater than about one-half inch relative to the second track. As embodied herein, the fastener can have a track open force of at least 3 pounds, as determined by ASTM test method F 88/F 88M-09.

According to yet another aspect of the disclosed subject matter, a slider for a reclosable fastener having a first track with a first engagement profile and a second track with a second engagement profile is provided. The slider includes a top wall, a first sidewall extending downwardly from the top wall and defining at least a portion of a first channel, the first channel having a first end and a second end with a longitudinal axis therebetween and being configured to receive the first engagement profile of the first track, and a second sidewall extending downwardly from the top wall and defining at least a portion of a second channel, the second channel having a first end and a second end with a longitudinal axis therebetween and being configured to receive the second engagement profile of the second track. At least a portion of the longitudinal axis of the first channel is angled toward the top wall relative to the longitudinal axis of the second channel.

In some embodiments, the at least a portion of the longitudinal axis of the first channel can be angled toward the top wall about 4 degrees relative to the longitudinal axis of the second channel. Additionally or alternatively, the at least a portion of the longitudinal axis of the first channel can be angled relative to the longitudinal axis of the second channel such that when the slider is moved from a closed position toward an open position along the first and second tracks, the slider can be configured to move the first track relative the second track. Additionally or alternatively, the at least a portion of the longitudinal axis of the first channel can be angled relative to the longitudinal axis of the second channel such that when the slider is moved from a closed position toward an open position along the first and second tracks, the slider can be configured to move the first track toward the top wall and from the second track to disengage the first and second engagement profiles. As embodied herein, the at least a portion of the longitudinal axis of the first channel can be angled relative to the longitudinal axis of the second channel such that when the slider is moved from the closed position toward the open position, the slider can be configured to move the first track a radius greater than about one-half inch relative to the second track.

Furthermore, and as embodied herein, at least one of the first and second sidewalls can have a projection extending therefrom to define at least a portion of a bottom surface of the slider. The projection can be configured to engage a corresponding one of the first and second engagement profiles to resist removal of the corresponding one of the first and second engagement profiles from a corresponding one of the first and second channels.

The slider can further include a separating finger extending from the top wall between the first and second sidewalls, and the separating finger can define a side boundary of each of the first and second channels. The separating finger can be configured to release a latch disposed on one of the first engagement profile or the second engagement profile to allow the first engagement profile to move upwardly relative to the second engagement profile.

In some embodiments, the slider can include a mold gating disposed proximate to a center of the top wall. The first and second channels each can define a straight path. Alternatively, at least one of the first and second channels can define a curved or S-shaped path.

DETAILED DESCRIPTION OF THE PREFERRED EMBODIMENT

Reference will now be made in detail to the present preferred embodiments of the application, examples of which are illustrated in the accompanying drawings. The fasteners presented herein generally are intended for thermoplastic bags, although other similar or suitable uses are contemplated. In accordance with the disclosed subject matter, a reclosable fastener is provided. The reclosable fastener includes a first track including a first engagement profile having a first hook portion opening in a first direction along a reference axis substantially perpendicular to a burst direction of the fastener and a second track including a second engagement profile having a second hook portion opening in a second direction opposite the first direction along the reference axis and configured to engage the first hook portion in a closed configuration. The first and second hook portions are configured to engage each other when the first and second tracks are urged toward each other along the reference axis, and the first and second hook portions are configured to disengage each other when the first and second tracks are urged away from each other along the reference axis.

Figures 1A, 1B, 1C:
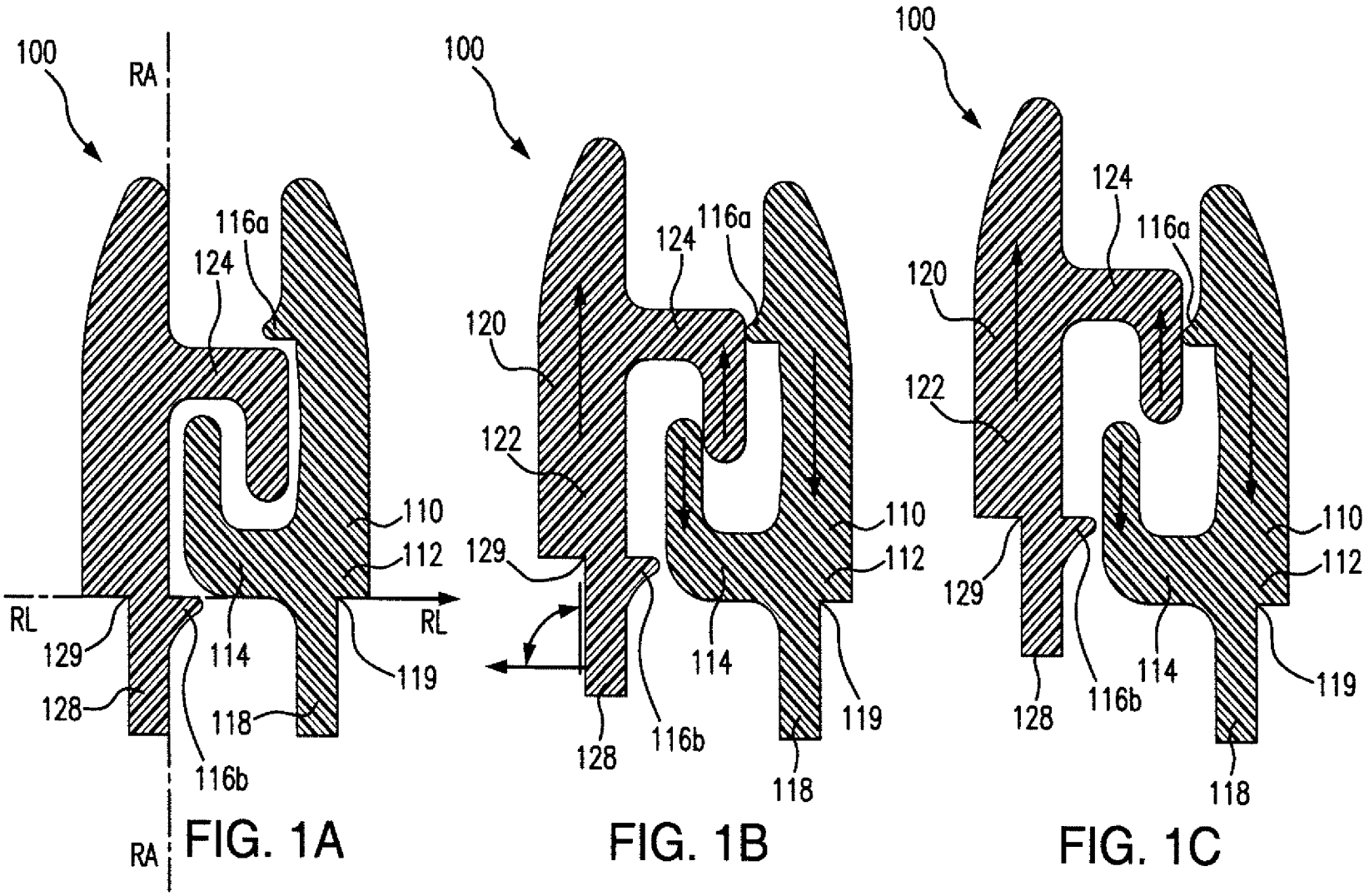
FIG. 1A is a cross-sectional schematic side view of a representative fastener in a closed configuration according to the disclosed subject matter.
FIG. 1B is a cross-sectional schematic side view of the fastener of FIG. 1A in an intermediate configuration.
FIG. 1C is a cross-sectional schematic side view of the fastener of FIG. 1A in an open configuration.
Figure 2:
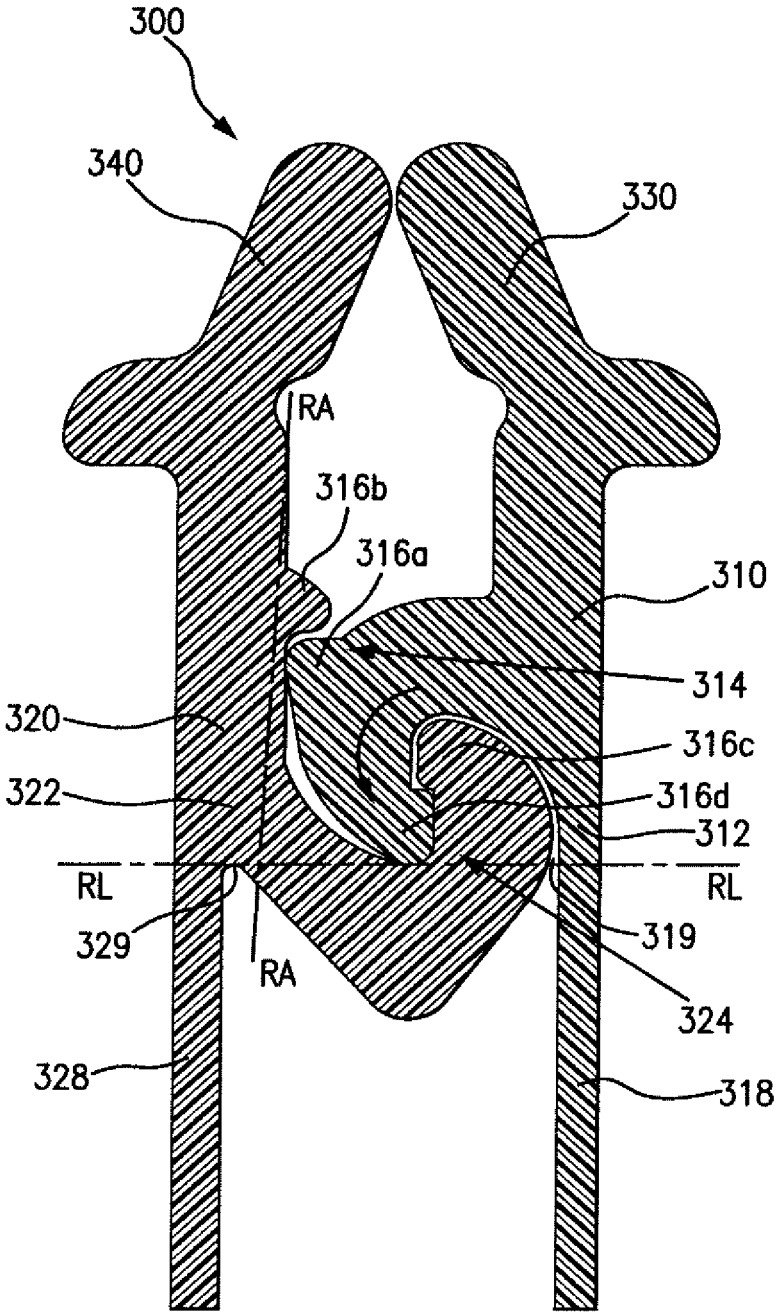
FIG. 2 is a cross-sectional schematic side view of another exemplary fastener according to the disclosed subject matter.
Figure 3:
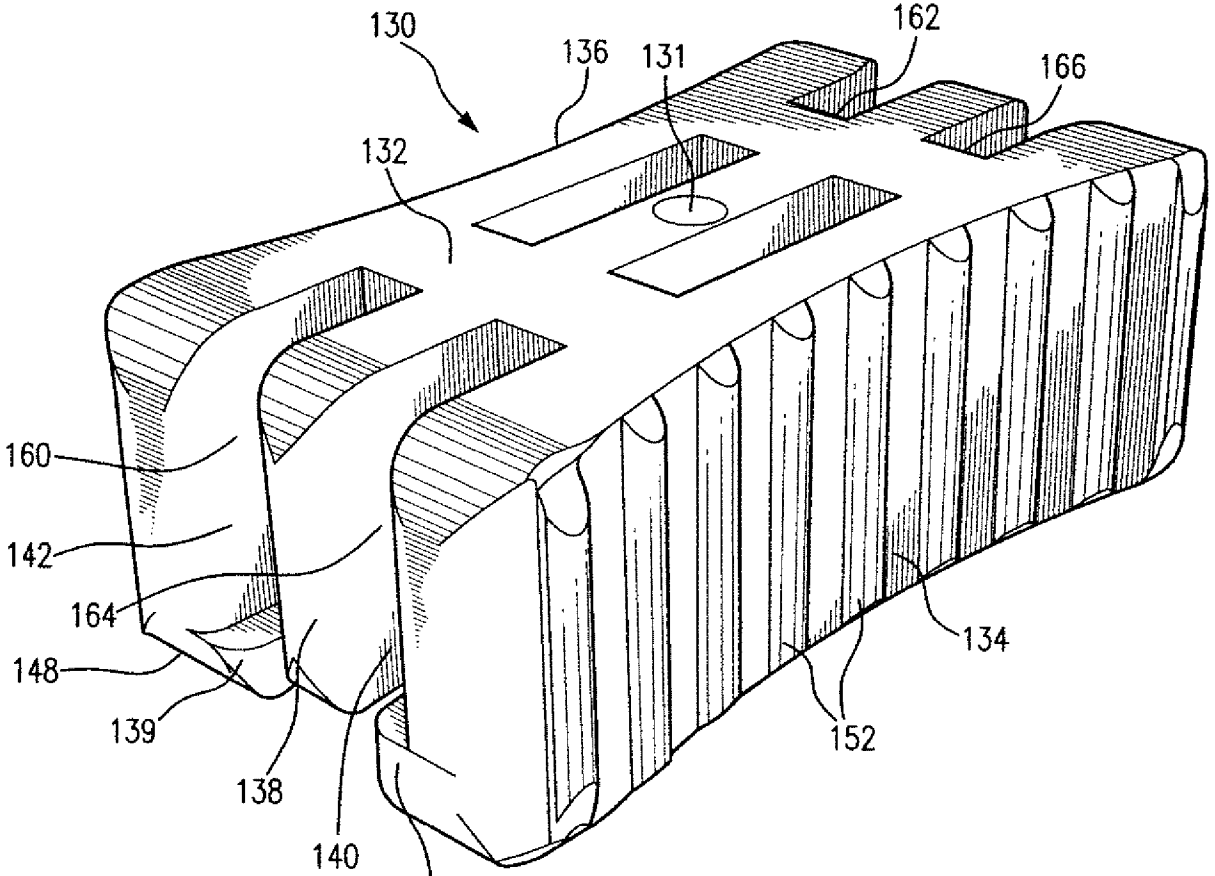
FIG. 3 is a perspective view of an exemplary slider according to the disclosed subject matter.

For purpose of explanation and illustration, and not limitation, a representative embodiment of a reclosable fastener in accordance with the application is shown in FIGS. 1-3 and is designated generally by reference character 100.

With reference to FIGS. 1A-1C, a representative fastener 100 includes a first track 110 and a second track 120. The first track 110 includes a first engagement profile 112. The first engagement profile 112 is configured with a first hook portion 114 opening in a first direction along a reference axis RA. As embodied herein, the reference axis is substantially perpendicular to a burst direction of the fastener 100, as described further below.

The second track 120 includes a second engagement profile 122. The second engagement profile 122 is configured to open in a second direction opposite the first direction along the reference axis RA. As embodied herein, the first hook portion 114 is configured to engage the second hook portion 124 in a closed configuration, as shown for example in FIG. 1A. In this manner, the first hook portion 114 and the second hook portion 124 are configured to engage each other when the first and second tracks 110, 120 are urged toward each other along the reference axis RA. Furthermore, and as shown for example in FIGS. 1B-1C, the first and second hook portions 114, 124 can be configured to disengage each other when the first and second tracks 110, 120 are urged away from each other along the reference axis RA.

The burst direction of the fastener is generally represented by the direction in which force would be applied in catastrophic conditions, such as an overstuffed bag and/or a bag exposed to sudden impact. The burst direction of the fastener 100 can be defined generally by a reference line RL extending across a bottom of the first engagement profile 112 and a bottom of the second engagement profile 122 in the closed configuration, for example as shown in FIG. 1A. As embodied herein, the reference axis RA is substantially perpendicular to the burst direction, such as ±5 degrees from perpendicular or within a range of 85-95 degrees of the burst direction. By configuring the first and second tracks 110, 120 to engage and disengage by movement along a reference axis RA that is substantially perpendicular to the burst direction, the force required to open and close the reclosable fastener 100 can be reduced substantially.

Furthermore, in some embodiments, first track 110 can include a first fin 118 extending from a first area 119 proximate the first engagement profile 112, and/or second track 120 can include a second fin 128 extending from a second area 129 proximate the second engagement profile 122. As such, additionally or alternatively, the burst direction of the fastener 100 can be defined by reference line RL extending through the first area 119 and the second area 129 in the closed condition.

The first engagement profile 112 can include a projection 116*a* to inhibit disengagement of the first and second engagement profiles 112, 122 when engaged in the closed configuration, as shown for example in FIGS. 1A-1C. For example and as embodied herein, the projection 116*a* can abut the second hook portion 124 when the first and second tracks 110, 120 are urged away from each other along the reference axis RA. Additionally or alternatively, the second engagement profile 122 can include a projection 116*b* to inhibit disengagement of the first and second engagement profiles 112, 122. Furthermore, and as described further below with reference to FIG. 2, a projection can be provided on one or more of the first hook portion 114 and the second hook portion 124.

As illustrated in FIGS. 1A-1C, fastener 100 can be moved from a closed configuration (FIG. 1A) to an intermediate configuration (FIG. 1B) to an open configuration. As shown in FIG. 1A, in the closed configuration, projections 116*a*, 116*b* can each abut a respective one of the first and second hook portions 114, 124 to inhibit movement of the second hook portion 124 out of engagement with the first hook portion 114. When the first and second tracks 110, 120 are each urged relatively away from each other along the reference axis RA, such as by movement of one or both of the first and second tracks 110, 120, as shown in FIG. 1B, the first and second hook portions 114, 124 can move past the respective projection 116*a*, 116*b* and out of engagement with each other. The movement of the first and second hook portions 114, 124 past the projections 116*a*, 116*b* can be due at least in part to a slight movement of the first and/or second tracks 110, 120 when urged relatively away from each other along the reference axis RA. In some embodiments, the first track 110 can have a relatively slight movement relative to the second track 120, corresponding to a relatively large bending radius. For example and as embodied herein, the bending radius for a track 110, 120 having an overall height of about 0.125 inches can be a 3.25 inch radius. FIG. 1C illustrates the fastener 100 approaching an open condition, with the first engagement profile 112 having moved out of engagement with the second engagement profile 112.

FIG. 2 illustrates another representative embodiment of a fastener 300 of the disclosed subject matter, including a first track 310 having a first engagement profile 312 and a second track 320 having a second engagement profile 322. The first engagement profile 312 is configured with a first hook portion 314 opening in a first direction generally along a reference axis RA substantially perpendicular to a burst direction of the fastener 300, as described herein. The second engagement profile 322 is configured to open in a second direction opposite the first direction along the reference axis RA. As embodied herein, the first hook portion 314 can be configured to engage the second hook portion 324 in a closed configuration, as shown for example in FIG. 2.

The first hook portion 314 and the second hook portion 324 are configured to engage each other when the first and second tracks 310, 320 are urged toward each other along the reference axis RA. Furthermore, and as shown and described in further detail with respect to FIGS. 6A-7B, the first and second hook portions 314, 324 are configured to disengage each other when the first and second tracks 310, 320 are urged away from each other along the reference axis RA.

As noted above, the burst direction of the fastener 300 can be defined generally by a reference line RL extending across a bottom of the first engagement profile 312 and a bottom of the second engagement profile 322, for example as shown in the closed configuration in FIG. 2. As such, the reference axis RA is substantially perpendicular to the burst direction, which can be defined as within a range of 85-95 degrees of the burst direction. Furthermore, in some embodiments, first track 310 can include a first fin 318 extending from a first area 319 proximate the first engagement profile 312, and second track 320 can include a second fin 328 extending from a second area 329 proximate the second engagement profile 322. As such, additionally or alternatively, the burst direction of the fastener 300 can be defined by reference line RL extending through the first area 319 and the second area 329 in the closed condition.

As embodied herein, the first engagement profile 312 and second engagement profile 322 can include projections 316*a-b* and 316*c-d* configured to inhibit disengagement of the first and second engagement profiles 312, 322 when engaged in the closed configuration, as shown for example in FIG. 2. For example and as embodied herein, in the closed configuration, projection 316*a*, disposed proximate an intermediate portion of first hook portion 314, can abut projection 316*b*, disposed at a suitable location on a surface of the second engagement profile 322. Additionally or alternatively, and as embodied herein, in the closed configuration, projection 316*c*, disposed proximate an end of first hook portion 314, can abut projection 316*d*, disposed proximate an end of second hook portion 324. The abutting arrangement of projections 316*a-b* and/or 316*c-d* can, at least in part, prevent or inhibit undesired disengagement of the first and second engagement profiles 312, 322.

Furthermore, the first and second hook portions 314, 324 are shaped with an interlocking geometry. For purpose of illustration and not limitation, the embodiment of FIG. 2 demonstrates that, in the closed configuration, first hook portion 314 can be curved inwardly toward second hook portion 324. Additionally or alternatively, and as embodied herein, in the closed configuration, second hook portion 324 can be curved inwardly toward first hook portion 314. In this manner, the interlocking geometry of first and second hook portions 314, 324 can provide a rotational spring force to further urge the first and second interlocking profiles 312, 322 into the closed configuration and prevent or inhibit undesired movement of the first and second tracks 310, 320 along the reference axis RA.

As discussed further below with respect to FIG. 6A-7B, the projections 316*a*-316*d* can be disengaged, and the rotational spring force can be overcome by a slight movement of the first track 310 away from the second track 320 to allow the first and second tracks 310, 320 to be urged away from each other along the reference axis RA. For example, and as noted above, the first track 310 can move with a slight movement relative to the second track 320, such as at a bending radius of about 3.25 inches for a track having a height of about 0.125 inches. The relatively slight bending, corresponding to a relatively large bending radius, can allow for fastener 300 to be opened and closed with a relatively low slide force, for example when operated with a slider, as described below.

Furthermore, first track 310 can include a first retention feature 330 extending upwardly from the first engagement profile 312, and second track 320 can include a second retention feature 340 extending upwardly from the second engagement profile 322. In the closed configuration, with no slider therebetween, first retention feature 330 can abut second retention 340, which can indicate to a user that a seal has been formed by the fastener 300. Further details of an exemplary fastener having first and second retention features are described in U.S. patent application Ser. No. 13/839,496, which is incorporated by reference herein in its entirety.

In accordance with another aspect of the disclosed subject matter, a slider for a reclosable fastener having a first track with a first engagement profile and a second track with a second engagement profile is provided. The slider includes a top wall, a first sidewall extending downwardly from the top wall and defining at least a portion of a first channel, the first channel having a first end and a second end with a longitudinal axis therebetween and being configured to receive the first engagement profile of the first track, and a second sidewall extending downwardly from the top wall and defining at least a portion of a second channel, the second channel having a first end and a second end with a longitudinal axis therebetween and being configured to receive the second engagement profile of the second track. At least a portion of the longitudinal axis of the first channel is angled toward the top wall relative to the longitudinal axis of the second channel.

Figure 4:
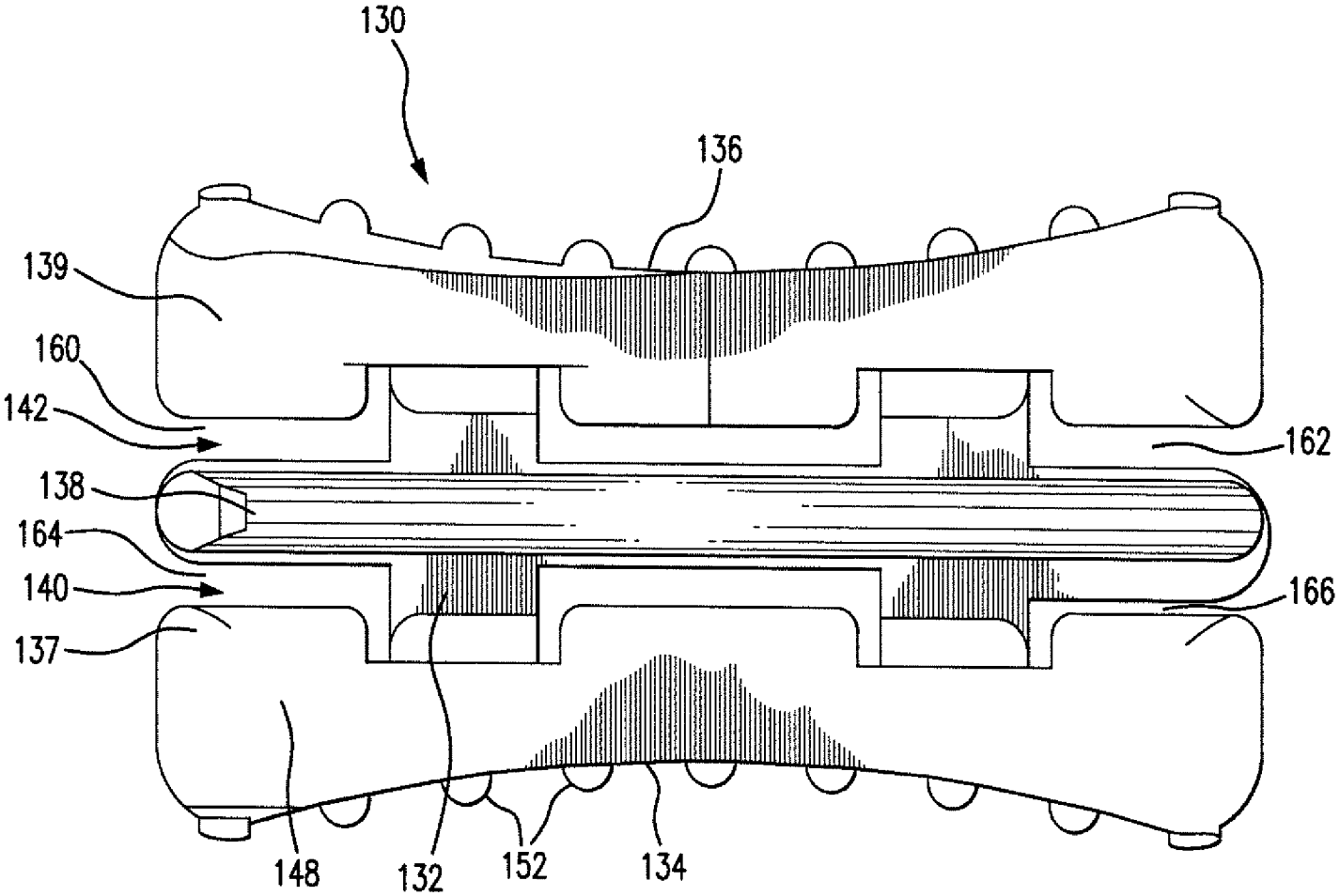
FIG. 4 is a bottom view of the slider of FIG. 3.
Figure 5:
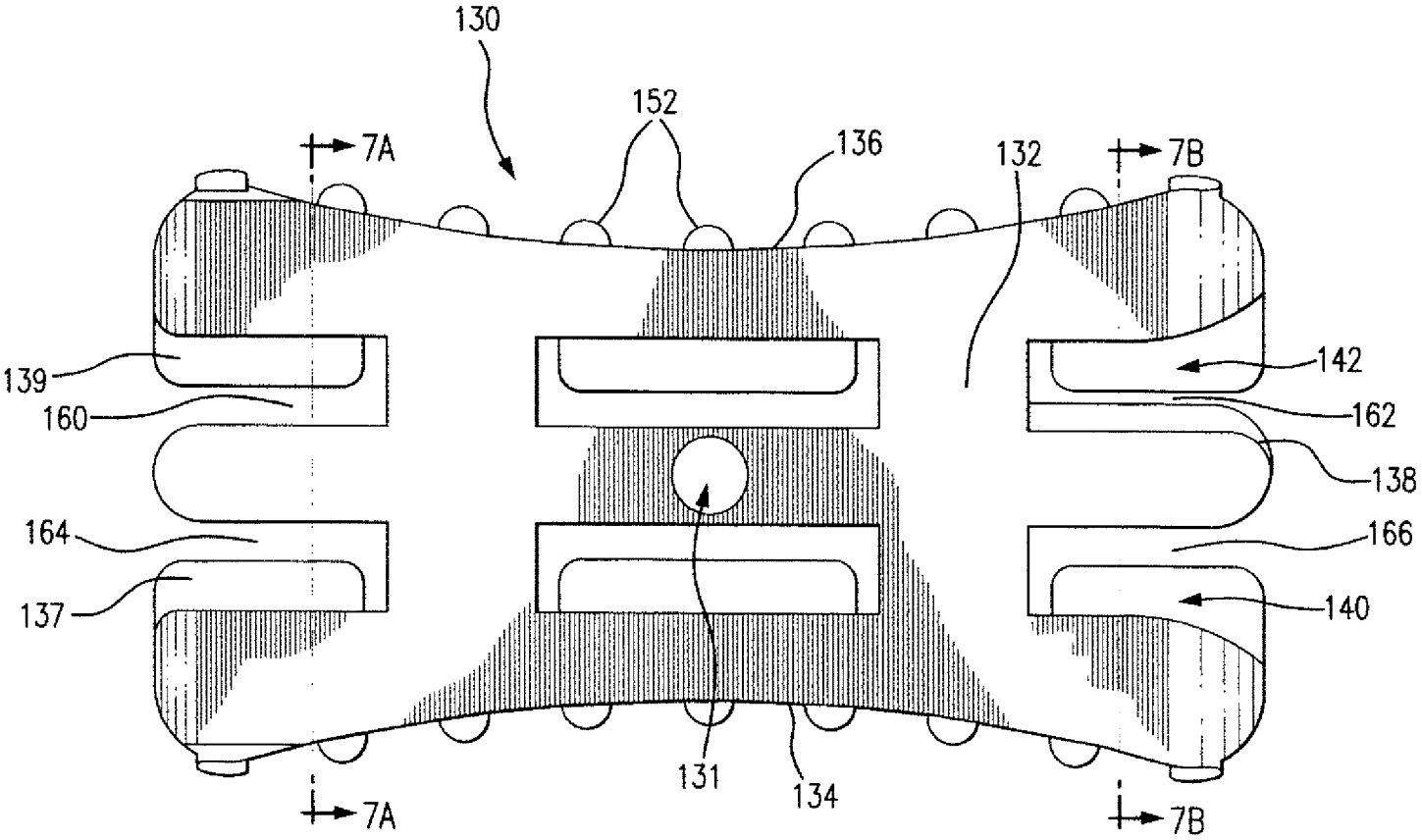
FIG. 5 is a top view of the slider of FIG. 3.

FIGS. 3-5 depict an exemplary slider 130. For purpose of illustration, reference is made to slider 130 engaged with fastener 300 of FIG. 2, although slider 130 can be similarly utilized with any suitable fastener configuration including, for example and without limitation, the fastener 100 of FIG. 1. For purpose of illustration and not limitation, the slider 130 depicted herein matingly engages first engagement profile 312 and second engagement profile 322 when moved along the first and second tracks 310, 320 from an open position toward a closed position. Likewise, slider 130 can be configured to disengage first engagement profile 312 from second engagement profile 322 when moved from the closed position toward the open position.

For example, with reference to FIGS. 3-5, slider 130 can be configured as an inverted U-shaped plastic member having top wall 132 positioned to move along the first and second tracks 310, 320 proximate to the top edges of the first and second tracks 310, 320. For example, slider 130 can include at least one sidewall extending downwardly from the top wall 132. As embodied herein, slider 130 includes a first sidewall 134 extending downwardly from the top wall 132 and a second sidewall 136 extending downwardly from the top wall 132 and spaced apart from first sidewall 134. The slider 130 further has a separator finger 138 formed along at least a portion of the length of the slider 130, extending from the top wall 132 and disposed between the first and second sidewalls 134, 136.

The at least one sidewall can include a projection extending inwardly therefrom and define at least a portion of a bottom surface 148 of the slider 130. For example and as embodied herein, first sidewall 134 can have a first projection 137 extending inwardly therefrom and along the length of slider 130, and the second sidewall 136 can have a second projection 139 extending inwardly therefrom, and thus toward the first projection 137, and extending along at least a portion of the length of slider 130. As such, the first projection 137 can define a bottom boundary of a first channel 140, which can have further boundaries defined by the first sidewall 134, the separator finger 138 and the top wall 132, and the second projection 139 can define a bottom boundary of a second channel 142, which can have further boundaries defined by the second sidewall 136, the separator finger 138 and the top wall 132.

As embodied herein, first sidewall 134 and second sidewall 136 can each be shaped with a concave curvature to provide an indentation for a user to grip the slider 130 at each side. Furthermore, and to facilitate gripping by the user, first and second sidewalls 134, 136 can each have one or inure ribs 152 extending from the top wall 132 to the bottom surface 148 of the slider 130 and spaced apart along the first and second sidewalls 134, 136.

Figure 8A:
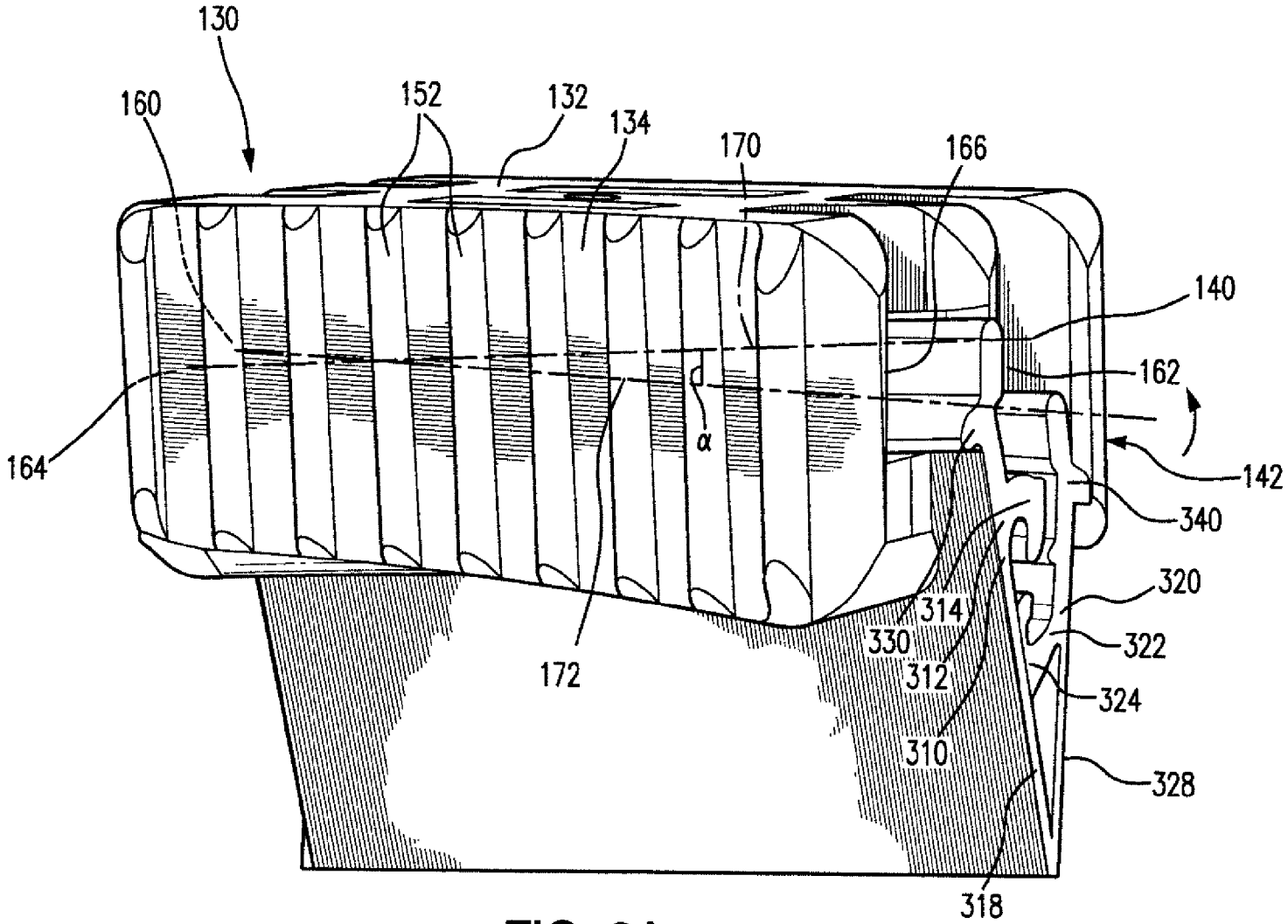
FIG. 8A is a front perspective view of the fastener of FIG. 2 with the slider of FIG. 3, illustrating the longitudinal axis of at least a portion of exemplary first and second channels, respectively, of the slider according to the disclosed subject matter.
Figure 8B:
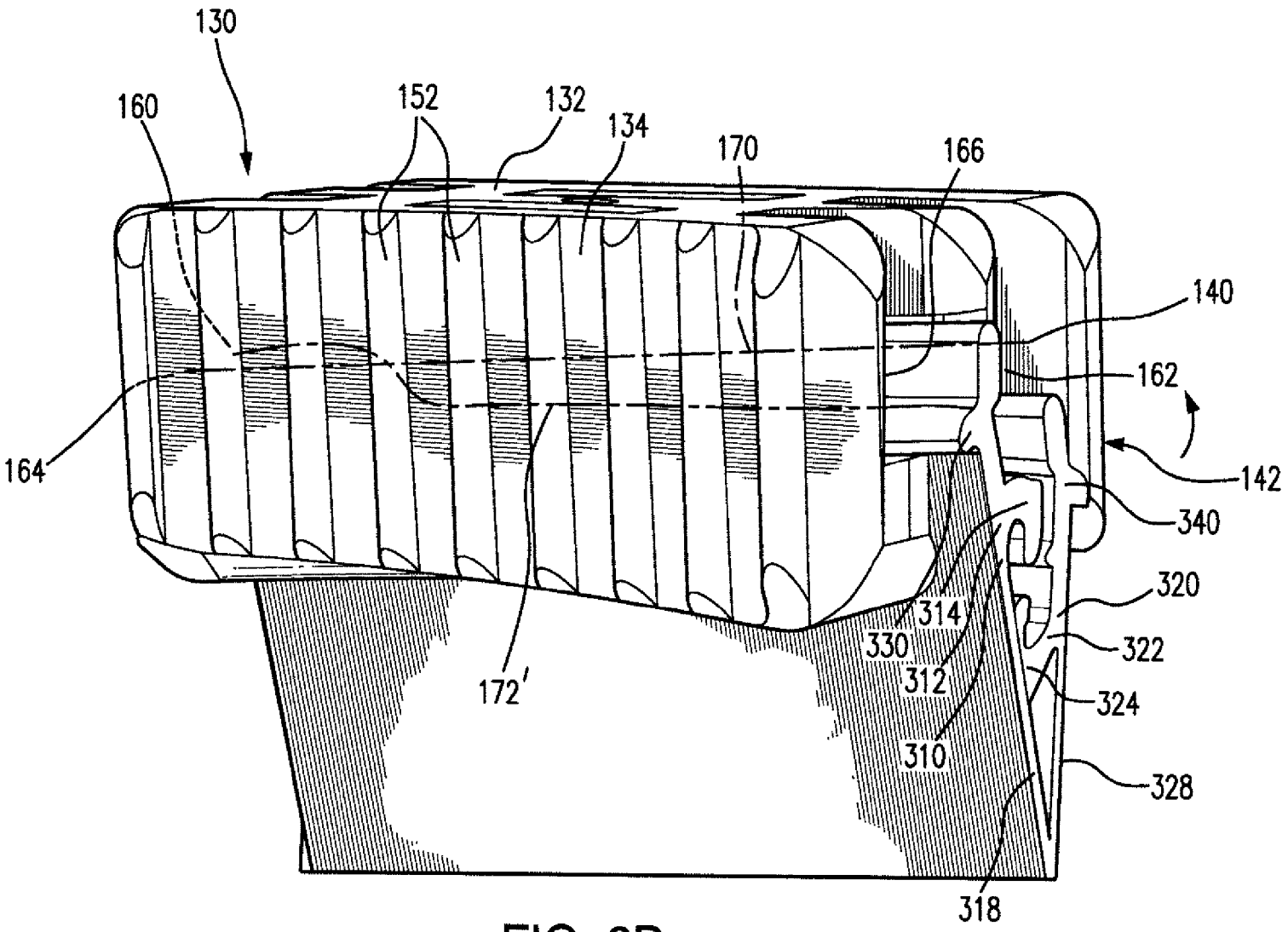
FIG. 8B is a front perspective view of the fastener of FIG. 2 with the slider of FIG. 3, illustrating the longitudinal axis of at least a portion of alternative first and second channels, respectively, of the slider according to the disclosed subject matter.

As illustrated in FIG. 8A, the first channel 140 can have a first end 166 and a second end 164, which can define a longitudinal axis 170 of the first channel 140 therebetween. Second channel 142 can have a first end 162 and a second end 160, which can define an longitudinal axis 172 of the second channel 142 therebetween. Furthermore, at least a portion of the longitudinal axis 170 of the first channel 140 can be angled relative to longitudinal axis 172 of the second channel 142. As such, for purpose of explanation and not limitation, first ends 162, 166 can correspond to an opening end of the slider 130, and second ends 160, 164 can correspond to a closing end of the slider 130. As embodied herein, longitudinal axes 170, 172 can be substantially aligned or at the same height proximate the second ends 160, 164 and can be separated or spaced at the first ends 162, 166 a height at least sufficient to disengage the first and second tracks 310, 320. The difference in height can be accomplished along the length of the slider 130, or along a portion thereof. For example, in some embodiments, an increasing difference in height between the longitudinal axes 170, 172 can be defined by an angle $\alpha$ therebetween, which can be, for example and without limitation, a four degree angle. Alternatively, the difference in height of the longitudinal axes 170, 172 from the second ends 160, 164 to the first ends 162, 166 can occur along a portion of the length of the slider 130. As a further alternative, as shown for example in FIG. 8B, longitudinal axis 172' can have a curved shape or S-shape to define the difference in height relative to longitudinal axis 170 along at least a portion of the length of the slider 130. With reference to FIGS. 8A-8B, and as further described below, moving slider 130 along first and second tracks 310, 320 in the direction of first ends 162, 166 can engage first and second engagement profiles 312, 322 into a closed configuration, i.e., portions of the first and second tracks 310, 320 extending from the closing end of the slider 130 will be engaged. Conversely, moving slider 130 along the first and second tracks 310, 320 in the direction of the second ends 160, 164 can disengage first and second engagement profiles 312, 322 into an open configuration, i.e., portions of the first and second tracks 310, 320 extending from the opening end of the slider 130 will be disengaged.

As shown in FIGS. 6A-7B, the first channel 140 and second channel 142 also can be configured to receive a first retention feature 330 of first track 310 and second retention feature 340 of second track 320, respectively, if provided to assist in engaging slider 130 to the first and second tracks 310, 320. Further details of an exemplary fastener having first and second retention features engaged to a slider are described in U.S. patent application Ser. No. 13/839,496, which is incorporated by reference herein in its entirety.

Figure 6B:
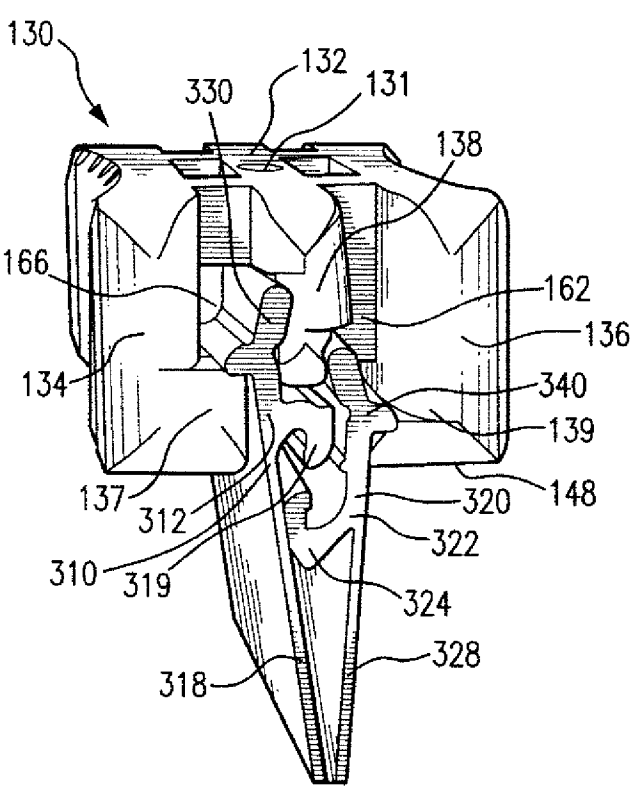
FIG. 6B is a side perspective view opposite FIG. 6A of the slider of FIG. 3 with the fastener of FIG. 2 shown disengaged and in cross-section.
Figure 6A:
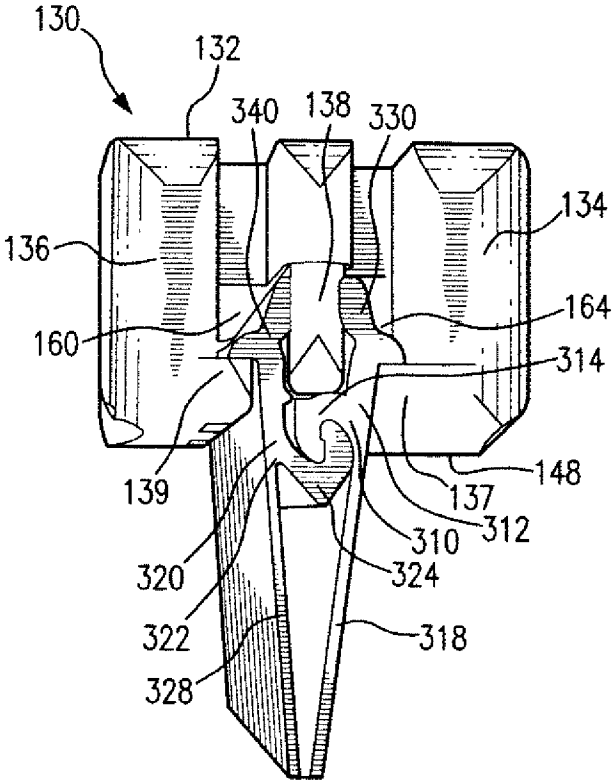
FIG. 6A is a side perspective view of the slider of FIG. 3, as mounted on the fastener of FIG. 2, shown engaged and in cross-section.

FIGS. 6A-7B illustrate the assembly and operation of slider 130 on first and second tracks 310, 320, wherein FIG. 6A shows the closing end of the representative slider 130 embodied herein with the first and second tracks 310, 320 in a closed configuration and FIG. 6B shows the opening end of the representative slider 130 with the first and second tracks 310, 320 in an open configuration. Additionally, reference is made to FIG. 2, which shows the first and second tracks 310, 320 in the closed configuration beyond the closing end of slider 130 as shown in FIG. 6A, such that projection 316*a* of first track 310 is in engagement with projection 316*b* of second track 320, and projection 316*c* is engagement with projection 316*d* to prevent or inhibit undesired movement of the first track 310 relative to the second track 320 along the reference axis RA. As noted above, movement of the slider 130 in the direction of the second ends 160, 164 and toward a closed portion of the first and second tracks 310, 320 disposes the separator finger 138 between the first and second retention features 330, 340 of the first and second tracks 310, 320, if provided, as shown for example in FIG. 7A. Furthermore, separator finger 138 can move the first and second engagement features 312, 322 slightly away from each other to disengage projection 316*a* from projection 316*b* and projection 316*c* from projection 316*d* to allow movement of the first track 310 relative to the second track 320 along the reference axis RA. Additionally, and as embodied herein, projection 137 of slider 130 engages an undercut portion of first retention feature 330, and projection 139 of slider 130 engages an undercut portion of second retention feature 340, with projections 137, 139 being substantially aligned.

Figure 7B:
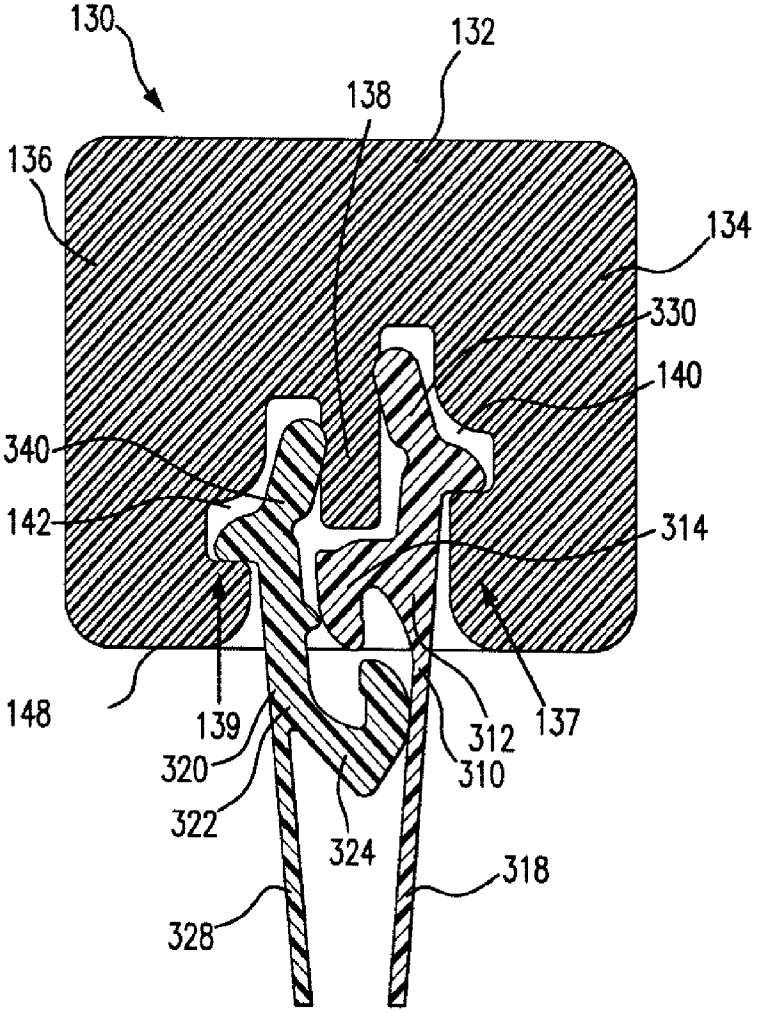
FIG. 7B is a cross-sectional schematic side view of the fastener of FIG. 2 with the slider of FIG. 3 taken along line 7B of FIG. 5.
Figure 7A:
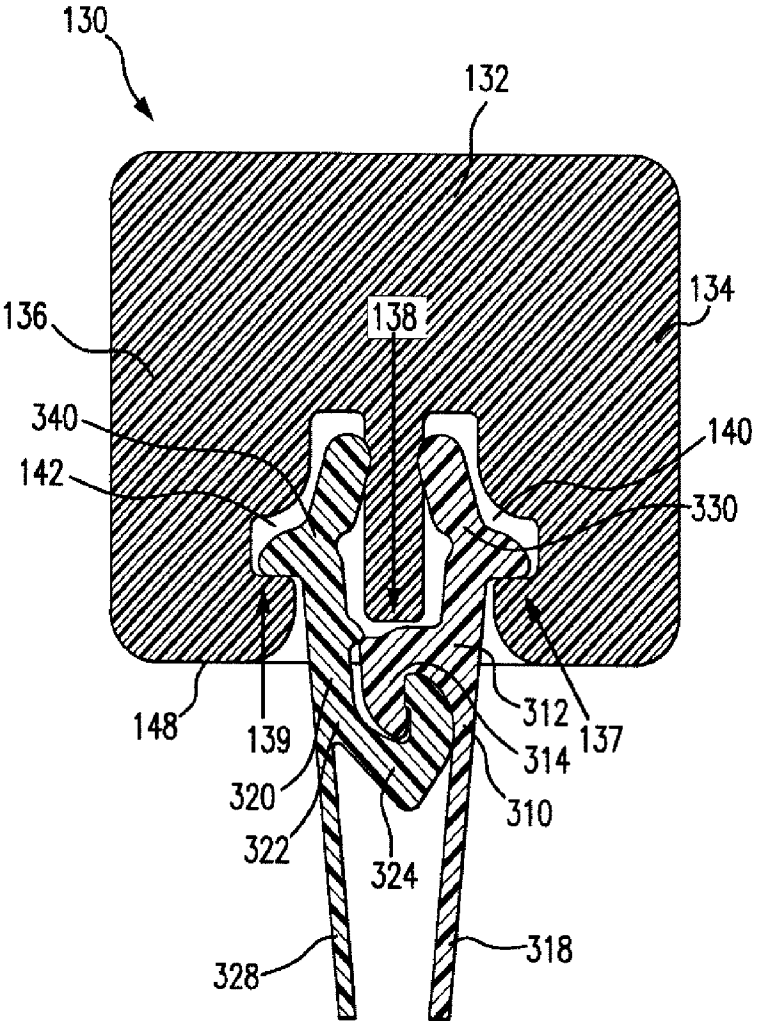
FIG. 7A is a cross-sectional schematic side view of the fastener of FIG. 2 with the slider of FIG. 3 taken along line 7A of FIG. 5.

Further movement of slider 130 in the direction of the second ends 160, 164 can urge the closed portion of first and second tracks 310, 320 that are received into the first and second channels 140, 142 into an increasingly separating or spaced relation due to the orientation of the longitudinal axes 170, 172 of first and second channels 140, 142. For example, and as shown in FIG. 7B, the height of projection 137 increases relative to projection 139 between the first ends 162, 166 and the second ends 160, 164, such that a force can be applied to undercut portion of first retention feature 330 away from the undercut portion of second retention feature 340. This arrangement urges first track 310 in a direction along reference axis RA (shown in FIG. 2) away from second track 320 to disengage first and second engagement profiles 312, 322 and open fastener 300.

Conversely, movement of slider 130 in the direction of first ends 162, 166 can urge an open portion of first and second tracks 310, 320, which is received into the first ends 162, 166 of first and second channels 140, 142, along the decreasingly separating relative height between longitudinal axes 170, 172 of first and second channels 140, 142. In this manner, as shown for example in FIGS. 7A-7B, the separation or space of first channel 140 decreases relative to second channel 142, and as such a force can be applied by the channel walls of first and second channels 140, 142 to urge first track 310 in a direction along reference axis RA toward second track 320 to engage first and second engagement profiles 312, 322 and close fastener 300.

With further movement of slider 130 in the direction of first ends 162, 166, slider 130 can move out of alignment with the closed portion of first and second tracks 310, 320, as shown in FIG. 2. In this manner, and as embodied herein for illustration and not limitation, the interlocking geometry of the first and second engagement profiles 312, 322 can provide a rotational spring force to further urge the first and second interlocking profiles 312, 322 into the closed configuration, as described above. Furthermore, projection 316*a* can engage projection 316*b*, and projection 316*c* can engage projection 316*d* to prevent vertical movement of first track 310 relative to second track 320, as described above.

The vertical movement of first and second tracks 310, 320 to open and close fastener 300 can allow for fastener 300 to be formed with a reduced width and material compared to conventional fasteners. As such, first and second tracks 310, 320 can be formed with first and second engagement profiles 312, 322 having a reduced width compared to conventional fasteners.

The first and second tracks 310, 320 can be made of any thermoplastics such as, for example, polyethylenes, including high density polyethylene (HDPE), medium density polyethylene (MDPE), low density polyethylene (LDPE), or mixtures thereof, polypropylene, polyethylene tetraphalate (PET), polyvinyl chloride (PVC), nylon or other suitable materials known in the art. Generally, using a stiffer grade material adds strength. Furthermore, first and second tracks 310, 320 can be opened and closed with a relatively slight movement, corresponding to a relatively large bending radius, as described above, and as such, stiffer grade materials can be utilized to form the first and second tracks 310, 320, which can provide improved burst strength while using less material.

For example and without limitation, slider 130 can be formed from suitable polymeric materials, such as nylon, polypropylene, polyethylene, polystyrene, copolymers of polyethylene and polypropylene, polycarbonates, polyesters, polyacetals, acrylic-butadiene-styrene copolymers or combinations thereof. The slider 130 can be formed by any suitable technique, for example, by injection molding. Furthermore, top wall 132 of slider can include a mold gating 131 disposed proximate the center of top wall 132, which can improve uniformity and efficiency of the injection molding.

Furthermore, in accordance with another aspect of the disclosed subject matter a reclosable bag is provided. The reclosable bag includes first and second opposing body panels fixedly connected to each other along a pair of sides and a bottom bridging the pair of sides and a reclosable fastener extending along a mouth formed opposite the bottom. The reclosable fastener includes a first track including a first engagement profile having a first hook portion opening in a first direction along a reference axis substantially perpendicular to a burst direction of the fastener, the first hook portion attached to the first body panel proximate a first area, and a second track including a second engagement profile having a second hook portion opening in a second direction opposite the first direction along the reference axis and configured to engage the first hook portion in a closed configuration, the second track portion attached to the second panel at a second area. The first and second hook portions are configured to engage each other when the first and second tracks are urged toward each other along the reference axis, and the first and second hook portions are configured to disengage each other when the first and second tracks are urged away from each other along the reference axis. Furthermore, the reclosable fastener can include a slider engaging the first and second tracks.

Figure 9:
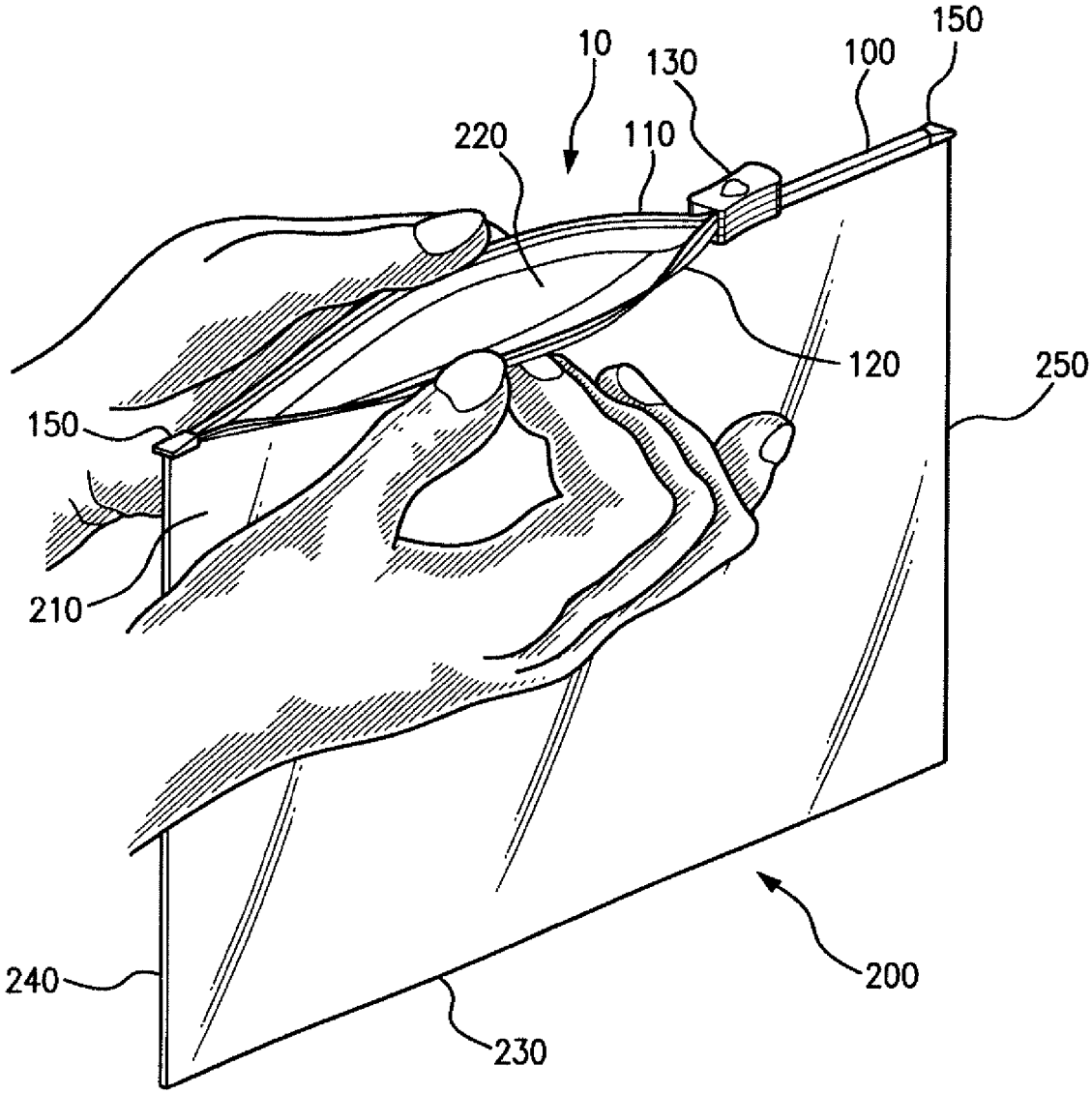
FIG. 9 is a perspective view of a portion of reclosable bag according to the disclosed subject matter.

For purpose of explanation and illustration, and not limitation, FIG. 9 shows an exemplary embodiment of a reclosable bag 200 in accordance with the disclosed subject matter. For purpose of illustration, reference is made to fastener 100, of FIGS. 1A-1C, although the fastener 300 of FIG. 2 can be similarly utilized. As depicted, the reclosable bag 200 includes first and second panels 210 and 220 each having a top, a bottom, and first and second opposing sides and reclosable fastener 100. The first and second panels 210, 220 are joined to each other along respective bottoms 230 and first and second opposing sides 240 and 250. A mouth is defined between the first and second opposing sides 240, 250 and opposite the bottom. The bag 200 may be made from any suitable thermoplastic film such for example as polyethylene or polypropylene or other suitable materials known in the art.

A reclosable fastener assembly 10 is disposed along the mouth. As embodied herein, the reclosable fastener assembly 10 comprises fastener 100 including first and second tracks 110, 120, which can be extruded separately and attached to the respective sides of the bag mouth, or alternatively, the first and second tracks 110, 120 can be extruded integral with the sides of the bag mouth. Slider 130 is shown in FIG. 9 assembled on the fastener 100 at the top edge or mouth of a thermoplastic bag 200.

The reclosable fastener 100 can have any suitable combination of the features described above. Furthermore, end stops 150 can be formed at each of the opposing ends of first and second tracks 110, 120 to prevent movement of the slider beyond the length of the first and second tracks 110, 120. Additional variations of the track and/or slider can be incorporated for use with the end stops of the disclosed subject matter. For example and without limitation, further details of exemplary fasteners including interlocking first and second tracks, a slider and end stops are described in U.S. patent application Ser. Nos. 13/839,496 and 13/839,044, each of which is incorporated by reference herein in its entirety.

Reclosable fasteners 300 having first and second tracks 310, 320 with first and second engagement profiles 312, 322, respectively, in accordance with the application were formed and the seal strength was tested. ASTM test method F 88/F 88M-09 was used to test the seal strength of the fasteners.

Specimens were cut to a width of 1.00 inch (with a tolerance of + or −0.5%) using a cutter conforming to the requirements of 5.4 of Test Methods D 882. The edges were clean-cut and perpendicular to the direction of seal. The length of the specimen fins could be of a different length depending on the grip dimensions of the testing machines. To perform the test, a constant rate-of-jaw-separation machine was used. The machine was equipped with a weighing system that moves a maximum distance of 2% of the specimen extension within the range being measured. The machine was equipped with a device for recording the tensile load and the amount of separation of the grips (both being accurate to + or −2%). The rate of separation of the jaws was uniform and capable of adjustment from approximately 8 to 12 inches per minute. The gripping system was capable of minimizing specimen slippage and applying an even stress distribution on the specimen. The machine was calibrated.

Each fin 318, 328 of the fastener 300 was secured in opposing grips of the testing machine and the fastener profiles remaining unsupported while the test was conducted. The fastener profiles were located approximately equidistant between the grips and about 0.25 inches from each of the grips. The specimen was aligned in the grips so that the fastener was perpendicular to the direction of pull while allowing sufficient slack so the fastener is not stressed prior to initiation of the test. The fastener specimen is then tested at a rate of grip separation of 10 inches per minute. For fasteners in accordance with the disclosed subject matter, the mean value of the force to open the track was 4.900 lbs. with a standard deviation of 0.484 lbs and a standard Error Mean of 0.217 lbs.

While the present application is described herein in terms of certain preferred embodiments, those skilled in the art will recognize that various modifications and improvements may be made to the application without departing from the scope thereof. Thus, it is intended that the present application include modifications and variations that are within the scope of the appended claims and their equivalents. Moreover, although individual features of one embodiment of the application may be discussed herein or shown in the drawings of one embodiment and not in other embodiments, it should be apparent that individual features of one embodiment may be combined with one or more features of another embodiment or features from a plurality of embodiments.

In addition to the specific embodiments claimed below, the application is also directed to other embodiments having any other possible combination of the dependent features claimed below and those disclosed above. As such, the particular features presented in the dependent claims and disclosed above can be combined with each other in other manners within the scope of the application such that the application should be recognized as also specifically directed to other embodiments having any other possible combinations. Thus, the foregoing description of specific embodiments of the application has been presented for purposes of illustration and description. It is not intended to be exhaustive or to limit the application to those embodiments disclosed.

The invention claimed is:

1. A reclosable fastener comprising:

a first track including a first engagement profile and a first retention feature extending therefrom, the first engagement profile comprising a first hook portion opening in a first direction along a reference axis substantially perpendicular to a burst direction of the fastener, the first retention feature comprising a first upward extension and a first outward extension; and a second track including a second engagement profile and a second retention feature extending therefrom, the second engagement profile comprising a second hook portion opening in a second direction opposite the first direction along the reference axis and configured to engage the first hook portion in a closed configuration, the second retention feature comprising a second upward extension and a second outward extension, wherein the first and second hook portions are configured to engage each other when the first and second tracks are urged toward each other along the reference axis to inhibit movement of the first track relative to the second track along the reference axis until at least one of the first and second upward extensions is urged in a direction transverse to the reference axis so as to allow the first and second hook portions to disengage from each other, wherein at least one of the first and second outward extensions has an undercut surface configured to disengage the first and second hook portions from each other when the undercut surface is urged along the reference axis.

2. The reclosable fastener of claim 1, wherein the reference axis is within 85-95 degrees of the burst direction.

3. The reclosable fastener of claim 1, wherein the burst direction is defined generally by a reference line extending across a bottom of the first engagement profile and a bottom of the second engagement profile.

4. The reclosable fastener of claim 1, wherein at least one of the first and second engagement profiles further comprises a projection to inhibit disengagement of the first and second hook portions when engaged.

5. The reclosable fastener of claim 4, wherein the projection is formed on at least one of the first hook portion and the second hook portion.

6. The reclosable fastener of claim 4, wherein the projection is formed on the first engagement profile to abut the second hook portion when the first and second tracks are urged away from each other along the reference axis.

7. The reclosable fastener of claim 1, wherein the first and second engagement profiles are configured to provide a rotational spring force to inhibit disengagement of the first and second hook portions when engaged.

8. The reclosable fastener of claim 1, further comprising a slider engaging the first and second retention features of the first and second tracks, wherein the first outward extension has the undercut surface and when the slider is moved from a closed position toward an open position along the first and second tracks, the slider is configured to urge the undercut surface away from the second track in a direction along the reference axis to disengage the first and second hook portions.

9. The reclosable fastener of claim 8, wherein when the slider is moved from the closed position toward the open position, the slider is configured to urge at least one of the first and second upward extensions away from the other one of the first and second upward extensions to allow the first hook portion and the second hook portion to disengage from each other.

10. The reclosable fastener of claim 1, wherein the fastener has a track open force of at least 3 pounds, as determined by ASTM test method F 88/F 88M-09.

11. A reclosable bag comprising:

first and second opposing body panels fixedly connected to each other along a pair of sides and a bottom bridging the pair of sides; and a reclosable fastener extending along a mouth formed opposite the bottom, the fastener comprising:

a first track including a first engagement profile and a first retention feature extending therefrom, the first engagement profile comprising a first hook portion opening in a first direction along a reference axis substantially perpendicular to a burst direction of the fastener, the first retention feature comprising a first upward extension and a first outward extension, the first track attached to the first body panel proximate a first area; and a second track including a second engagement profile and a second retention feature extending therefrom, the second engagement profile comprising a second hook portion opening in a second direction opposite the first direction along the reference axis and configured to engage the first hook portion in a closed configuration, the second retention feature comprising a second upward extension and a second outward extension, the second track attached to the second panel proximate a second area;

wherein the first and second hook portions are configured to engage each other when the first and second tracks are urged toward each other along the reference axis to inhibit movement of the first track relative to the second track along the reference axis until at least one of the first and second upward extensions is urged in a direction transverse to the reference axis so as to allow the first and second hook portions to disengage from each other, wherein at least one of the first and second outward extensions has an undercut surface configured to disengage the first and second hook portions from each other when the undercut surface is urged along the reference axis.

12. The reclosable bag of claim 11, wherein the reference axis is within 85-95 degrees of the burst direction.

13. The reclosable bag of claim 11, wherein the burst direction is defined generally by a reference line extending through the first area and the second area.

14. The reclosable bag of claim 11, wherein at least one of the first and second engagement profiles further comprises a projection to inhibit disengagement of the first and second hook portions when engaged.

15. The reclosable bag of claim 14, wherein the projection is formed on at least one of the first hook portion and the second hook portion.

16. The reclosable bag of claim 14, wherein the projection is formed on the first engagement profile to abut the second hook portion when the first and second tracks are urged away from each other along the reference axis.

17. The reclosable bag of claim 11, wherein the first and second engagement profiles are configured to provide a rotational spring force to inhibit disengagement of the first and second hook portions when engaged.

18. The reclosable bag of claim 11, further comprising a slider engaging the first and second retention features of the first and second tracks, wherein the first outward extension has the undercut surface and when the slider is moved from a closed position toward an open position along the first and second tracks, the slider is configured to urge the undercut surface away from the second track along the reference axis to disengage the first and second hook portions.

19. The reclosable bag of claim 18, wherein when the slider is moved from the closed position toward the open position, the slider is configured to urge at least one of the first and second upward extensions away from the other one of the first and second upward extensions to allow the first hook portion and the second hook portion to disengage from each other.

20. The reclosable bag of claim 11, wherein the fastener has a track open force of at least 3 pounds, as determined by ASTM test method F 88/F 88M-09.

* * * * *